US009702673B1

(12) United States Patent
Ginetto et al.

(10) Patent No.: US 9,702,673 B1
(45) Date of Patent: Jul. 11, 2017

(54) PROJECTILE TAIL BOOM WITH SELF-LOCKING FIN

(71) Applicants: Stephen Ginetto, Carlstadt, NJ (US); Andrew Moramarco, Staten Island, NY (US); Leanne Mohla, Blairstown, NJ (US)

(72) Inventors: Stephen Ginetto, Carlstadt, NJ (US); Andrew Moramarco, Staten Island, NY (US); Leanne Mohla, Blairstown, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 324 days.

(21) Appl. No.: 14/495,023

(22) Filed: Sep. 24, 2014

(51) Int. Cl.
*F42B 10/00* (2006.01)
*F42B 10/20* (2006.01)

(52) U.S. Cl.
CPC ..... *F42B 10/20* (2013.01)

(58) Field of Classification Search
CPC ..... F42B 10/14; F42B 10/20; F42B 10/18; F42B 10/32; F42B 10/64; F42B 10/10; F42B 10/30; F42B 10/06; F41F 3/308
See application file for complete search history.

(56) References Cited

U.S. PATENT DOCUMENTS 2,801,586 A * 8/1957 Mongello ..... F41A 33/00 102/372
2,968,245 A * 1/1961 Sutton ..... F42B 10/30 102/377
3,007,410 A * 11/1961 Blacker ..... F42B 15/00 102/380
3,819,132 A * 6/1974 Rusbach ..... F42B 10/18 244/3.28
3,944,168 A * 3/1976 Bizien ..... F42B 10/20 244/3.28
4,291,627 A * 9/1981 Ziemba ..... F42C 9/148 102/211
5,080,017 A * 1/1992 Asikainen ..... F42B 30/10 102/285
5,452,864 A * 9/1995 Alford ..... F42B 10/26 244/3.23
5,762,291 A * 6/1998 Hollis ..... F42B 10/50 244/3.21
6,502,786 B2 * 1/2003 Rupert ..... F42B 10/50 244/3.1
6,779,463 B2 * 8/2004 Mutascio ..... F42B 12/46 102/373
7,104,497 B2 * 9/2006 Johnsson ..... F42B 10/16 244/3.29

(Continued)

*Primary Examiner* — Brian M O'Hara
*Assistant Examiner* — Assres H Woldemaryam
(74) *Attorney, Agent, or Firm* — Michael C. Sachs

(57) ABSTRACT

A tail boom for a gun-launched projectile includes a boom housing and a cap fixed to a rear end of the boom housing. A piston is translatable in the housing by the force of a compression spring. A plurality of fins are rotatably fixed to the boom housing. Each fin includes a protruding portion that extends into a translation path of the piston. The cap includes a guide bore for the piston stem to maintain alignment of the piston. The piston presses on the protruding portion of the fins, causing the fins to rotate about their hinge points into a deployed position.

16 Claims, 7 Drawing Sheets

(56) References Cited

U.S. PATENT DOCUMENTS

| | | | | |
|---|---|---|---|---|
| 7,150,235 | B1 * | 12/2006 | Mikhail | F42B 10/06 102/518 |
| 7,851,734 | B1 * | 12/2010 | Hash | F42B 10/18 244/3.24 |
| 8,434,394 | B1 * | 5/2013 | Malejko | F42B 10/14 102/374 |
| 8,592,737 | B2 * | 11/2013 | Deschatre | F42B 10/14 244/3.27 |
| 8,624,171 | B2 * | 1/2014 | Frey, Jr. | F42B 10/06 244/3.1 |
| 8,735,789 | B1 * | 5/2014 | Malejko | F42B 10/06 244/3.24 |
| 8,916,810 | B2 * | 12/2014 | Geswender | F42B 10/26 244/3.23 |
| 2008/0006736 | A1 * | 1/2008 | Banks | F42B 10/64 244/3.21 |
| 2010/0282895 | A1 * | 11/2010 | Geswender | F42B 10/14 244/3.29 |
| 2013/0206897 | A1 * | 8/2013 | Rastegar | F42B 15/01 244/3.24 |
| 2014/0291441 | A1 * | 10/2014 | Bellotte | F02K 9/976 244/3.28 |

* cited by examiner

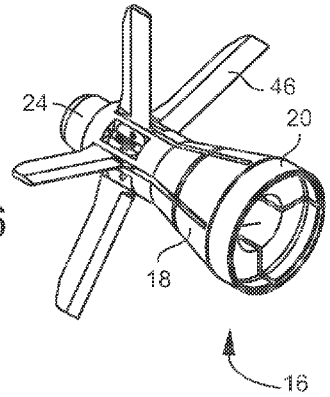
Fig. 6
Fig. 7
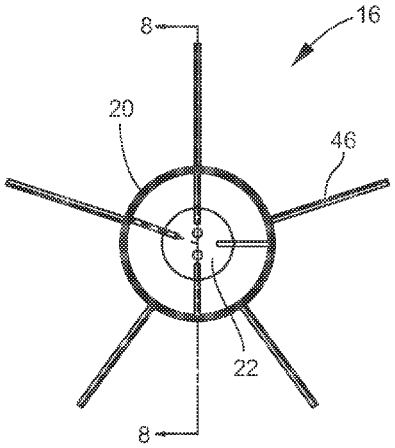
Fig. 9
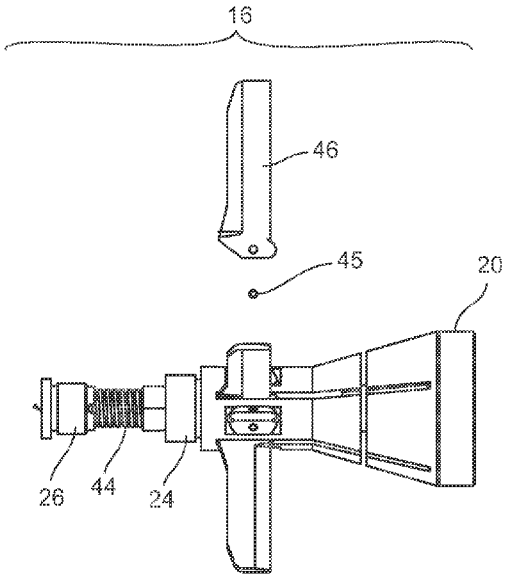

PROJECTILE TAIL BOOM WITH SELF-LOCKING FIN

STATEMENT OF GOVERNMENT INTEREST

The inventions described herein may be manufactured, used and licensed by or for the United States Government.

BACKGROUND OF THE INVENTION

The invention relates in general to gun-launched projectiles and in particular to stabilizing fins for gun-launched projectiles.

Tail fins and tail booms have been used to stabilize non-spinning projectiles. In a large caliber gun system, high projectile velocities and high gas pressures are typical. The high velocities and pressures can be used in several ways to deploy stabilizing fins. Each fin may be configured in such a way that, when the fin exits the constraint of the gun tube, the center of gravity of the fin enables the fin to open (inertia-based deployment). Another deployment method uses the air resistance at muzzle exit to act on a drag feature of the fin to deploy the fin. For shoulder-launched munitions, the projectile may have a relatively low velocity and the known deployment methods may not deploy the fins.

A gas piston deployment system has been used in shoulder-launched munitions. The gas piston mechanism enables the fins to deploy during launch. While the projectile is still in the launch tube, the propellant gases enter the fin boom to charge the gas cylinder. After the projectile exits the launch tube, the pressure surrounding the boom drops, which closes the valve to the gas cylinder. The gas cylinder acts as a piston and moves forward, deploying the fins. The piston presses on the tabs that free the fins to rotate open about the pivot point. When fully deployed, the back end of the fin is forced into a press fit section of the boom to maintain deployment.

Another known deployment method uses a spring for each fin. Each spring opens its respective fin after the fin is free of the launch tube.

Fin deployment for low velocity, shoulder-launched munitions can be complex. In the known gas piston deployment method, tight tolerances are required on an already complex component, the tail boom. Machining the boom is very costly and time consuming. The addition of press fit features to maintain fin deployment is not economical. In some cases, debris from the burning propellant could clog the small valve in the gas piston. The wide range of gun chamber pressures and operational temperatures also introduces variability and uncertainty in gas operated fin deployment.

In the spring-operated deployment method, because each fin has its own spring, the fins may open unevenly. Also, installing individual springs is labor intensive. Importantly, the placement of components on the outermost surface of the projectile introduces undesirable breaks or discontinuities in the smooth contour of the projectile. These breaks in the smooth contours disturb projectile flight and significantly increase drag.

A need exists for a fin deployment mechanism for a relatively low velocity projectile.

SUMMARY OF INVENTION

One aspect of the invention is a tail boom for a gun-launched projectile. The tail boom includes a boom housing having a central longitudinal axis. The boom housing has a forward end configured to engage a projectile body and a through bore. A cap is fixed to a rear end of the boom housing. The cap includes an outer cylindrical portion that engages a surface of the through bore in the housing and an inner cylindrical portion having a bore therein.

A piston is centered on the central longitudinal axis and is translatable in the through bore in the boom housing. The piston has a forward curved surface and a stem that extends rearward. The stem is translatable in and engages a surface of the bore of the inner cylindrical portion of the cap. A compression spring is disposed around the inner cylindrical portion of the cap. One end of the compression spring bears on the piston and the other end of the compression spring bears on the cap to bias the piston in a forward direction.

A plurality of fins are rotatably fixed to the boom housing. Each fin includes a protruding portion that extends into a forward translation path of the piston in a stowed position of the fins.

The forward curved surface of the piston may be a hemispherical surface.

The protruding portion of each fin that extends into the forward translation path of the piston may be a curved portion.

In a deployed position of the fins, each fin may include a planar portion parallel to the central longitudinal axis of the boom housing. The piston may include a cylindrical surface that adjoins the forward curved surface. In the deployed position of the fins, the planar portion of each fin may abut the cylindrical surface of the piston.

The through bore of the tail boom housing may include a chamfer that reduces a diameter of the through bore to less than a diameter of the piston. The chamfer may be located at an end of the forward translation path of the piston.

The tail boom housing may include, for each of the plurality of fins, a stop surface that is angled with respect to the central longitudinal axis. In the deployed position of the fins, a trailing portion of each fin may abut the stop surface.

Another aspect of the invention is a gun-launched projectile having a novel tail boom.

In another aspect, the invention includes a method of deploying a plurality of fins on a tail boom of a projectile. The method includes using a single compression spring to translate a piston in the tail boom. The piston presses on a projection of each of the fins to rotate the fins into a deployed position.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 6 is a perspective view of the tail boom of FIG. 1 with the fins in a deployed position.

FIG. 7 is a front end view of the tail boom of FIG. 6.

FIG. 9 is a partially exploded side view of the tail boom of FIG. 6.

DETAILED DESCRIPTION

Figure 1:
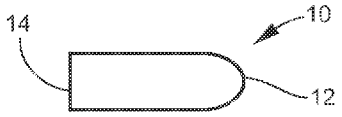
Fig. 1 PRIOR ART
FIG. 1 is a schematic of one embodiment of a projectile.
Figure 3:
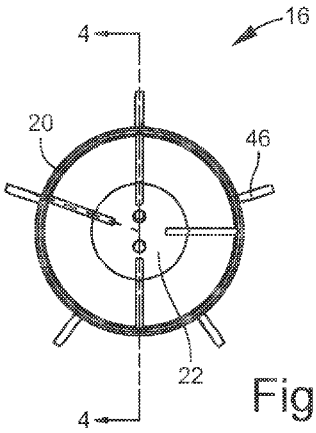
FIG. 3 is a front end view of the tail boom of FIG. 2.
Figure 2:
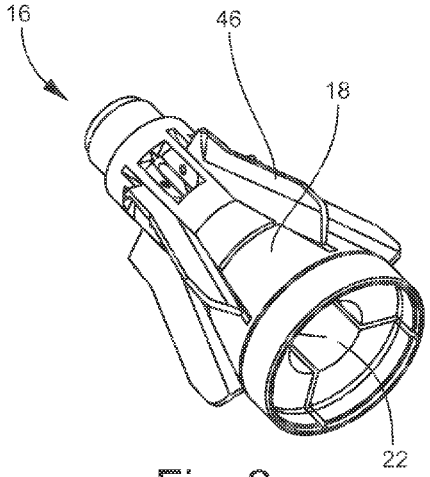
FIG. 2 is a perspective view of one embodiment of a tail boom with fins in a stowed position.
Figure 5:
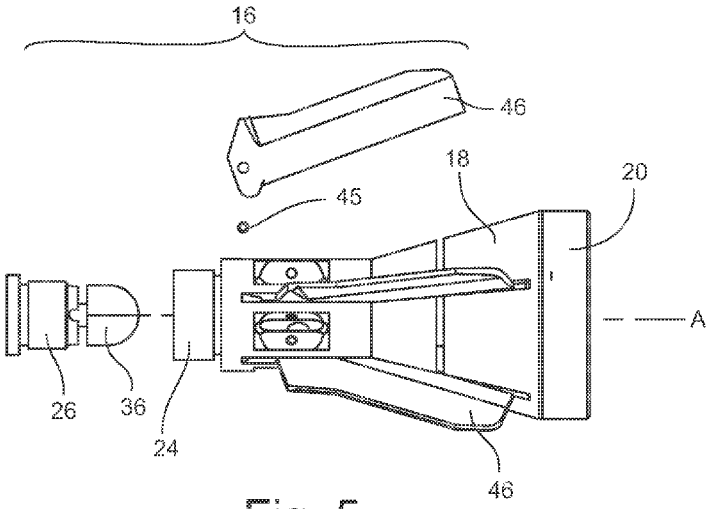
FIG. 5 is a partially exploded side view of the tail boom of FIG. 1.
Figure 4:
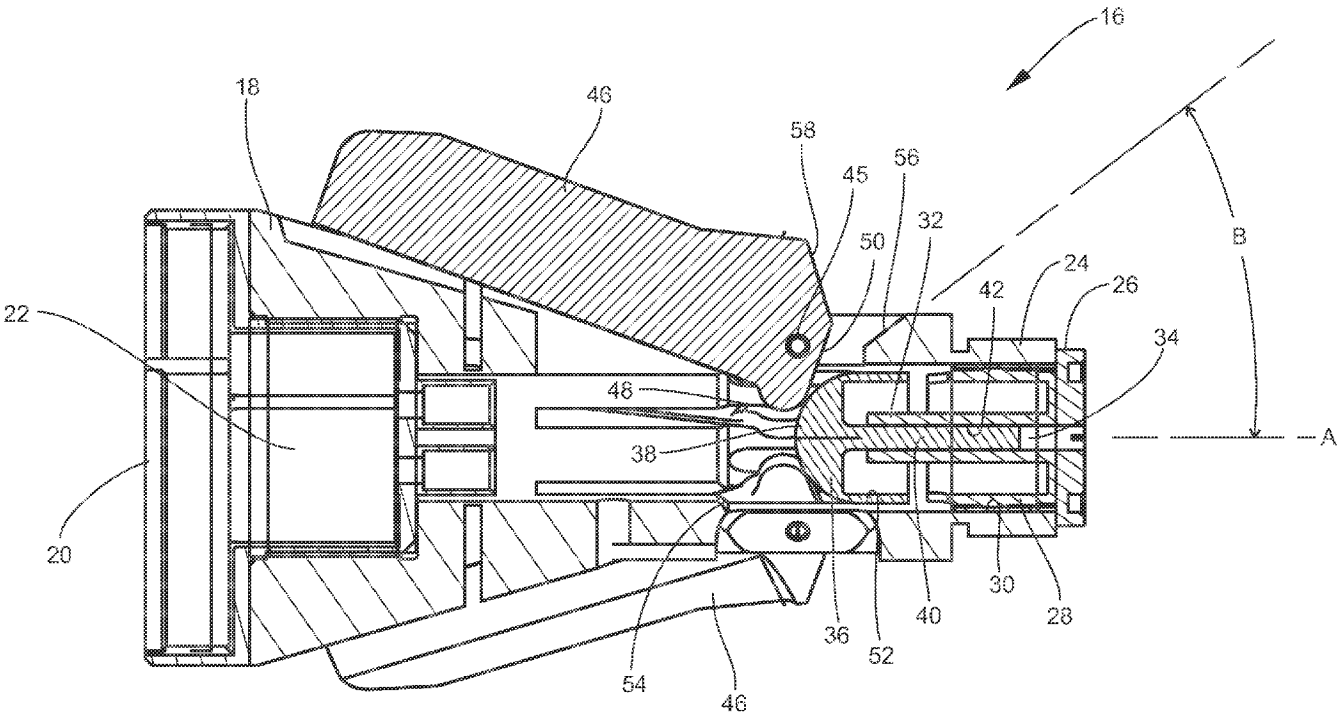
FIG. 4 is a sectional view taken along the line 4-4 of FIG. 3.
Figure 8:
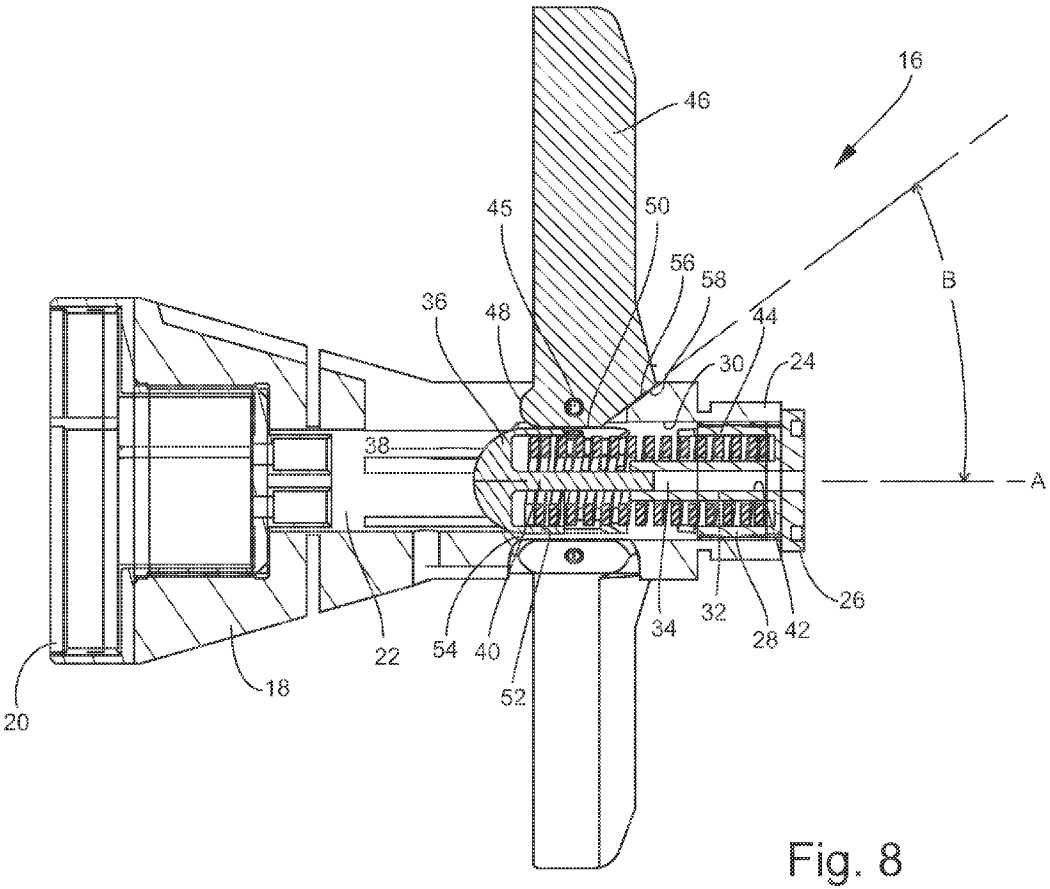
FIG. 8 is a sectional view taken along the line 8-8 of FIG. 7.
Figure 10A:
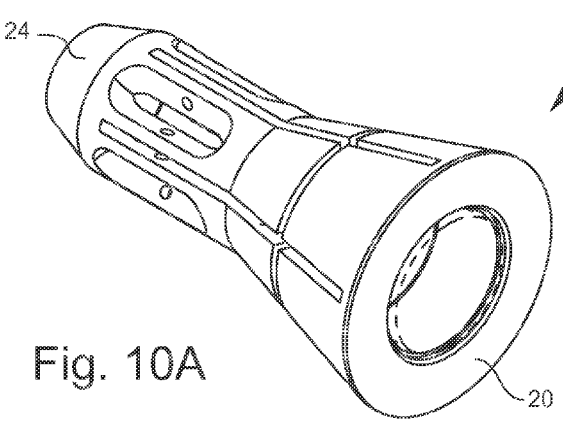
FIGS. 10A and 10B are perspective and front end views, respectively, of one embodiment of a tail boom housing.
Figure 10B:
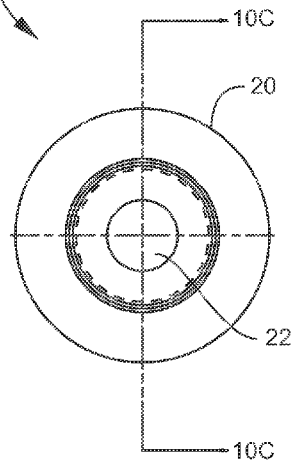
Figure 10D:
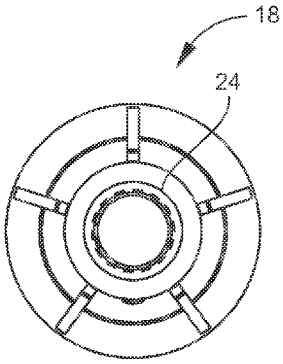
FIG. 10D is a rear end view of the tail boom housing of FIG. 10A.
Figure 10C:
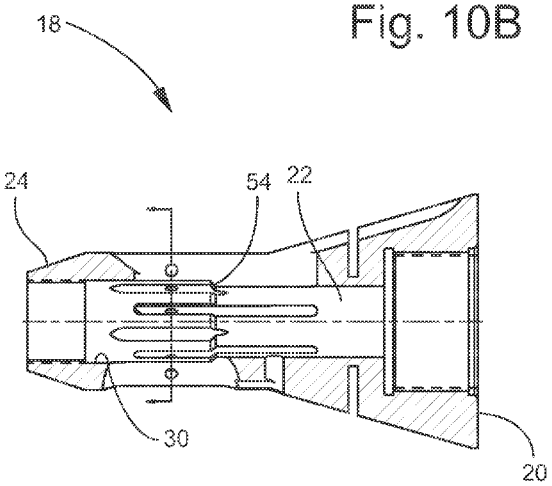
FIG. 10C is a sectional view taken along the line 10C-10C of FIG. 10B.

FIG. 1 is a schematic of one embodiment of a projectile 10. Projectile 10 includes a nose end 12 and a rear end 14. A tail boom having deployable fins may be fixed to the rear end 14 of projectile 10 to stabilize its flight. The caliber of projectile 10 may vary, for example, from about 40 mm to 100 mm or larger. When fitted with the novel tail boom disclosed herein, projectile 10 may be launched from a variety of gun tubes and weapons. For example, projectile 10 may be launched from a single use, shoulder-fired munition. The novel tail boom is advantageous for use with low velocity projectiles because the fins will reliably deploy, even at the low velocities associated with some shoulder-fired munitions.

Figure 12A:
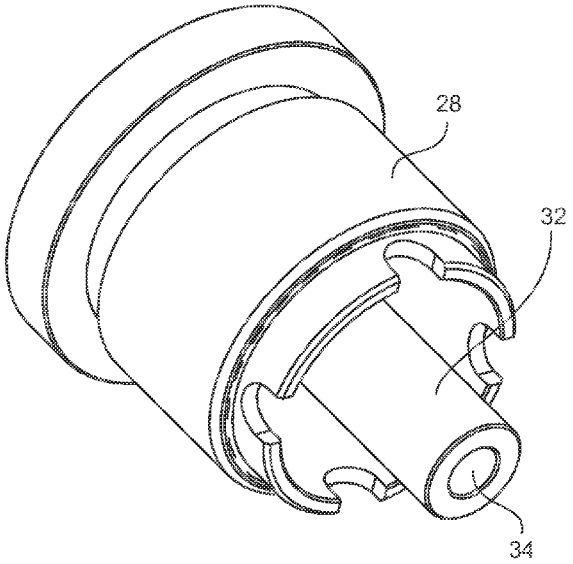
FIGS. 12A, 12B and 12C are perspective, front end, and sectional views of one embodiment of a cap.
Figure 12B:
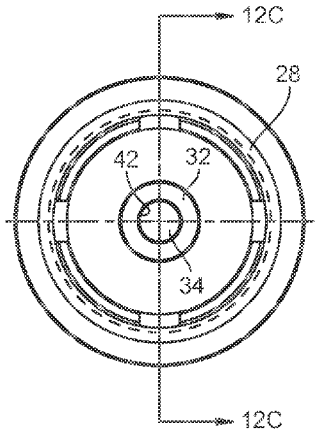
Figure 12C:
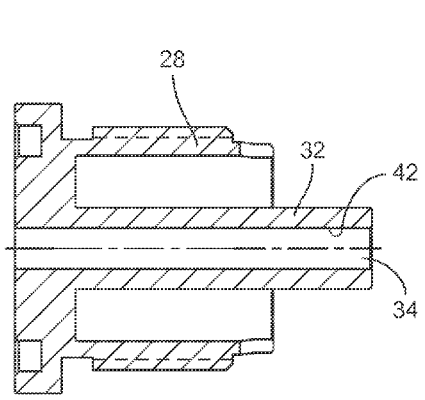

FIGS. 2-5 show one embodiment of a novel tail boom 16 with fins 46 in the stowed position. FIGS. 6-9 show tail boom 16 with fins 46 in the deployed position. Tail boom 16 includes a boom housing 18 having a central longitudinal axis A. The boom housing 18 only is shown in detail in FIGS. 10A-D. A forward end 20 of housing 18 is configured to engage and be fixed to the rear end 14 of a projectile 10. Housing 18 has a through bore 22. A cap 26 is fixed to a rear end 24 of the boom housing 18. Cap 26 only is shown in detail in FIGS. 12A-C. Cap 26 includes an outer cylindrical portion 28 that engages a surface 30 of the through bore 22 in the housing 18. Cap 26 includes an inner cylindrical portion 32 having a bore 34 therein.

Figure 11A:
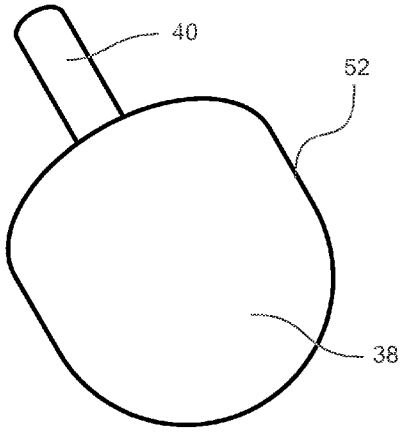
FIGS. 11A, 11B and 11C are perspective, front end, and sectional views of one embodiment of a piston.
Figure 11B:
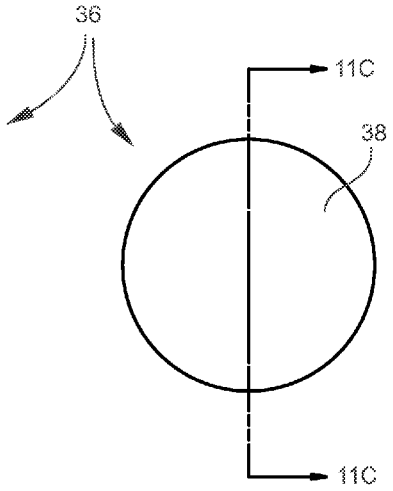
Figure 11C:
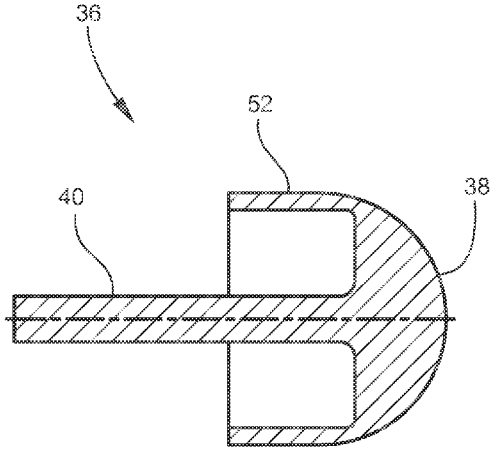

A piston 36 is centered on the central longitudinal axis A. The piston 36 only is shown in detail in FIGS. 11A-C. Piston 36 is translatable in the through bore 22 in the boom housing 18. The piston 36 has a forward curved surface 38. Surface 38 may have a hemispherical shape. A stem 40 extends rearward from surface 38. Stem 40 is translatable in and engages a surface 42 of the bore 34 of the inner cylindrical portion 32 of the cap 26. A compression spring 44 (not shown in FIG. 4, see FIG. 8) is disposed around the inner cylindrical portion 32 of the cap 26. One end of the compression spring 34 bears on the piston 36 and the other end of the compression spring 34 bears on the cap 26. Spring 34 biases piston 36 in a forward direction toward forward end 20 of housing 18.

A plurality of fins 46 are rotatably fixed to the boom housing 18. Fins may be fixed to housing 18 with fin pins 45. Five fins 46 are shown in the Figs., but the number of fins 46 may vary. Each fin 46 includes a protruding portion 48 that extends into a forward translation path of the piston 36, in the stowed position of the fins 46 (FIGS. 2-5). In the disclosed embodiment, the protruding portion 48 of each fin 46 that extends into the forward translation path of the piston 36 is a curved portion. In the deployed position of the fins 46 (FIGS. 6-9), each fin 46 includes a planar portion 50 that is parallel to the central longitudinal axis A of the boom housing 18.

The piston 36 includes a cylindrical surface 52 that adjoins the forward curved surface 38. In the deployed position of the fins 46 (FIGS. 6-9), the planar portion 50 of each fin 46 abuts the cylindrical surface 52 of the piston 36. At the forward end of the piston's translation path, the through bore surface 30 includes a chamfer 54. Chamfer 54 reduces the diameter of through bore 22 to a diameter less than the diameter of piston 36.

The tail boom housing 18 includes, for each of the plurality of fins 46, a stop surface 56 that forms an angle B with respect to the central longitudinal axis A. In the deployed position of the fins 46, a trailing portion 58 of each fin 46 abuts its respective stop surface 56.

The boom housing 18, cap 26, fins 46 and piston 36 may be made of, for example, aluminum alloy.

Prior to insertion in a launch tube, the fins 46 may be held in the stowed position (folded forward as in FIGS. 2-5) by a cord, strap, or wire (not shown) of suitable material for handling purposes. After the projectile 10 with tail boom 16 is inserted in the launch tube, the cord is cut and the launch tube maintains the fins 46 in the stowed position. The fins 46 remain in the stowed position until muzzle exit. For single use, shoulder-fired munitions, the projectile 10 may be loaded in the launch tube as part of the manufacturing process.

When projectile 10 with tail boom 16 exits the muzzle of the launch tube, compression spring 44 translates piston 36 in the forward direction. Piston 36 is guided by the surface 30 of through bore 22 and the stem 40 that translates in bore 34 of cap 26. Piston 36 presses against protruding portions 48 of fins 46, thereby deploying all the tins 46 simultaneously and with equally distributed force. The fins 46 stop against the angled stop surfaces 56 on the tail boom housing 18. Angled stop surfaces 56 reduce the transmission of the impact forces to the fin base through the fin hinge pin.

The piston 36 continues to translate forward in through bore 22 until piston 36 stops against chamfer 54. The combination of the geometry of chamfer 54 and forward curved surface 38 of piston 36 creates a force fit between the piston 36 and the boom housing 18, thereby fixing the piston 36 in place. In addition, the continued force from the spring 44 biases the piston 36 into chamfer 54, thereby maintaining the position of the piston 36. Thus, the piston 36 maintains the deployed position of the fins 46. The cylindrical surface 52 of piston 36 abuts the planar portion 50 of the fins to prevent the fins 50 from returning to the stowed position.

The use of a single spring 44 for fin deployment enables the fins 46 to deploy simultaneously with equal force. The contoured stop surface 56 for the fins 46 redirects the impact forces to preserve fin integrity. The chamfer 54 maintains piston position and fin deployment with no added parts. The single spring 44 provides a constant and well-defined deployment event, as compared to gas-operated pistons. The through bore surface 30 and the stem 40 disposed in bore 34 prevent piston 36 from jamming or becoming cocked during fin deployment. The mating surfaces of the piston 36 and chamfer 54 are interference surfaces that render the piston 36 stuck at the end of its travel.

While the invention has been described with reference to certain embodiments, numerous changes, alterations and modifications to the described embodiments are possible without departing from the spirit and scope of the invention as defined in the appended claims, and equivalents thereof

What is claimed is:

1. A tail boom for a gun-launched projectile, comprising:

a boom housing having a central longitudinal axis, a forward end configured to engage a projectile body and a through bore;

a cap fixed to a rear end of the boom housing, the cap including an outer cylindrical portion that engages a surface of the through bore in the housing and an inner cylindrical portion having a bore therein;

a piston centered on the central longitudinal axis and translatable in the through bore in the boom housing, the piston having a forward curved surface and a stem that extends rearward, the stem being translatable in and engaging a surface of the bore of the inner cylindrical portion of the cap;

a compression spring disposed around the inner cylindrical portion of the cap, one end of the compression spring bearing on the piston and the other end of the compression spring bearing on the cap to bias the piston in a forward direction; and a plurality of fins rotatably fixed to the boom housing, each fin including a protruding portion that extends into a forward translation path of the piston in a stowed position of the fins.

2. The tail boom of claim 1, wherein the forward curved surface of the piston is a hemispherical surface.

3. The tail boom of claim 1, wherein the boom housing, cap, fins and piston are made of an aluminum alloy.

4. The tail boom of claim 1, wherein the protruding portion of each fin that extends into the forward translation path of the piston is a curved portion.

5. The tail boom of claim 4, wherein, in a deployed position of the fins, each fin includes a planar portion parallel to the central longitudinal axis of the boom housing.

6. The tail boom of claim 5, wherein the piston includes a cylindrical surface that adjoins the forward curved surface.

7. The tail boom of claim 6, wherein, in the deployed position of the fins, the planar portion of each fin abuts the cylindrical surface of the piston.

8. The tail boom of claim 7, wherein the through bore of the tail boom housing includes a chamfer that reduces a diameter of the through bore to less than a diameter of the piston, the chamfer being located at an end of the forward translation path of the piston.

9. The tail boom of claim 8, wherein the tail boom housing includes, for each of the plurality of fins, a stop surface that is angled with respect to the central longitudinal axis.

10. The tail boom of claim 9, wherein, in the deployed position of the fins, a trailing portion of each fin abuts the stop surface.

11. A gun-launched projectile including the tail boom of claim 1.

12. A tail boom for a gun-launched projectile, comprising:

a boom housing having a central longitudinal axis, a forward end configured to engage a projectile body and a through bore;

a cap fixed to a rear end of the boom housing, the cap including an outer cylindrical portion that engages a surface of the through bore in the housing and an inner cylindrical portion having a bore therein;

a piston centered on the central longitudinal axis and translatable in the through bore in the boom housing, the piston having a forward hemispherical surface and a stem that extends rearward, the stem being translatable in and engaging a surface of the bore of the inner cylindrical portion of the cap;

a compression spring disposed around the inner cylindrical portion of the cap, one end of the compression spring bearing on the piston and the other end of the compression spring bearing on the cap to bias the piston in a forward direction; and a plurality of fins rotatably fixed to the boom housing, each fin including a protruding curved portion that extends into a forward translation path of the piston in a stowed position of the fins.

13. The tail boom of claim 12, wherein the piston includes a cylindrical surface that adjoins the forward curved surface.

14. The tail boom of claim 13, wherein the through bore of the tail boom housing includes a chamfer that reduces a diameter of the through bore to less than a diameter of the piston, the chamfer being located at an end of the forward translation path of the piston.

15. The tail boom of claim 14, wherein, in a deployed position of the fins, each fin includes a planar portion parallel to the central longitudinal axis of the boom housing.

16. The tail boom of claim 15, wherein, in the deployed position of the fins, the planar portion of each fin abuts the cylindrical surface of the piston.

* * * * *